US006683521B2

(12) United States Patent
Snider

(10) Patent No.: US 6,683,521 B2
(45) Date of Patent: Jan. 27, 2004

(54) SELF-PACKAGED MAGNETIC HAND TOOL ASSEMBLY

(75) Inventor: Greg S. Snider, Medina, OH (US)

(73) Assignee: Sulo Enterprises, Grafton, OH (US)

( * ) Notice: Subject to any disclaimer, the term of this patent is extended or adjusted under 35 U.S.C. 154(b) by 118 days.

(21) Appl. No.: 09/812,259

(22) Filed: Mar. 19, 2001

(65) Prior Publication Data

US 2002/0130746 A1 Sep. 19, 2002

(51) Int. Cl.[7] ..... H01F 7/02
(52) U.S. Cl. ..... 335/302; 294/65.5
(58) Field of Search ..... 335/302, 303, 335/304, 305, 306

(56) References Cited

U.S. PATENT DOCUMENTS

| | | | | | |
|---|---|---|---|---|---|
| 4,504,088 | A | | 3/1985 | Carter | 294/65.5 |
| 4,802,702 | A | | 2/1989 | Bownds | 294/65.5 |
| 4,810,987 | A | * | 3/1989 | Liebthal et al. | 335/302 |
| 4,813,729 | A | | 3/1989 | Speckhart | 294/65.5 |
| 5,154,978 | A | * | 10/1992 | Nakayama et al. | 428/469 |
| 5,169,193 | A | | 12/1992 | Stelmach | 294/65.5 |
| 5,333,767 | A | * | 8/1994 | Anderson | 224/183 |
| 5,472,253 | A | | 12/1995 | Resor | 294/65.5 |
| 5,624,146 | A | | 4/1997 | De Los Reyes et al. | 294/65.5 |
| 5,999,074 | A | | 12/1999 | Coleman, Jr. | 335/285 |
| 6,056,339 | A | | 5/2000 | Berger | 294/65.5 |
| 6,076,873 | A | | 6/2000 | Hung | 294/65.5 |

* cited by examiner

*Primary Examiner*—Michael Friedhofer
*Assistant Examiner*—Bernard Rojas
(74) *Attorney, Agent, or Firm*—Roetzel & Andress

(57) ABSTRACT

A self-packaged magnetic tool assembly has protective components which also serve as retail packaging, to facilitate retail sales without the need for any extraneous or temporary packaging. The magnetic tool assembly has a permanently charged elongated rectangular-shaped magnet encased by two ferrous metal side plates along a length of the magnet, and a single non-magnetic stainless steel plate connecting the two side plates. The ferrous metal side plates act as the north and south poles of the magnet assembly. The magnet and metal plates are encased in a protective cover on all but the primary attracting surfaces of the magnet and the side plates, thereby reducing unwanted magnetic attraction to other surfaces of the tool. Two removable rectangular plastic spacers are inserted over the primary attracting surfaces of the magnet and the side plates. The spacers serve as packaging elements which protect the primary attracting surface, and which can be selectively removed during use of the tool. A gap between the two spacers enables testing of the strength of the magnet in a retail packaged configuration. The spacers can be held in place by friction or by friction or by adhesive film bearing product information.

36 Claims, 2 Drawing Sheets

SELF-PACKAGED MAGNETIC HAND TOOL ASSEMBLY

FIELD OF THE INVENTION

The present invention relates to packaging of magnetic tools. More specifically, specific packaging of magnetic tools that allows safer handling by the consumer in a retail environment, and which increases the safety and convenience of open retail display of such tools. The various packaging concepts of the invention increase the likelihood of impulse purchases of the tools, by allowing safe hands-on protection and test usage, by eliminating the need for confining or concealing packaging which prohibits handling, viewing and testing of the tools. the invention relates to a magnetic pick-up tool having a wide range of consumer uses due to its novel configuration that also increases the safety and convenience of open retail display of the tool.

BACKGROUND OF THE INVENTION

The use of magnets for retrieving or lifting ferrous materials and objects is well known in industrial applications. However, industrial grade magnets are not conveniently configured for universal, domestic or non-industrial applications. Because they have not been traditionally sold through consumer retail distribution, there has not heretofore been developed any consumer-friendly packaging of magnets or magnetic tools, particularly those having larger and stronger magnets.

For magnets, traditional packaging such as cardboard boxes has been used to protect the brittle magnetic material, and to prevent multiple magnets from bonding together in shipment and storage. Although effective for shipment of industrial sales, such packaging is actually a hindrance to retail sales, where the product is preferably exposed for customer inspection. Other associated problems with magnet packaging of the prior art include inconvenient and possibly hazardous results, such as the tools becoming stuck together during transportation; the tools becoming stuck together where a person's fingers may be caught in between; attraction to other objects displayed nearby; and attraction to objects that customers or employees may be holding. Scratching or damage to retail fixtures as magnets attract to each other, increasing wear on the packaging and the displays, crushing boxes, pulling off skin cards, etc. Without extra packaging, a way to label the magnet assembly is required. The ability to eliminate extra packaging reduces the cost of manufacturing and shipping the magnet assembly, and the space required for its display. The present invention addresses the need for an inexpensive, easily manufactured, multipurpose magnetic pick-up tool that is made with integral components which also function as protective permanent packaging which facilitates retail sales, increase impulse purchases by facilitating handling and testing, extends product shelf life, and cuts down on damaged goods returns.

SUMMARY OF THE INVENTION

The present invention overcomes these and other disadvantages of the prior art, by providing a magnet tool assembly which has highly functional attributes which also serve as packaging elements which facilitate retail sales of the tool. The particular configuration of the present invention provides a solution to previous problems with safe and convenient and efficient retail display of magnet type tools. The invention utilizes protective cover elements as integral components of the magnet assembly, which serve both functionally to protect the magnet assembly, diminish magnetic attraction in lateral directions, and as integral and permanent retail packaging. The protective cover for the magnet assembly and eliminates the need to paint the outer surfaces. The gap between the plastic spacers allows the strength of the magnet assembly to be tested on-site in a retail setting.

In a particular embodiment, the magnet tool assembly has at least one generally rectangular-shaped permanent magnet having generally a top, a bottom, two longitudinal sides, and two lateral sides, at least two generally rectangular ferrous metal plates attached to said longitudinal sides of said permanent magnet, whereby said ferrous metal plates serve as the north and south magnetic poles of said magnet tool assembly, at least one primary attracting surface consisting of the bottom of said permanent magnet and the portions of said ferrous metal plates adjacent to the bottom of said permanent magnet, at least one non-magnetic plate oriented parallel to the top of said permanent magnet connecting said ferrous metal plates, and a cover that covers said ferrous metal plates, said non-magnetic connecting plate, and said permanent magnet.

BRIEF DESCRIPTION OF THE DRAWINGS

The Invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
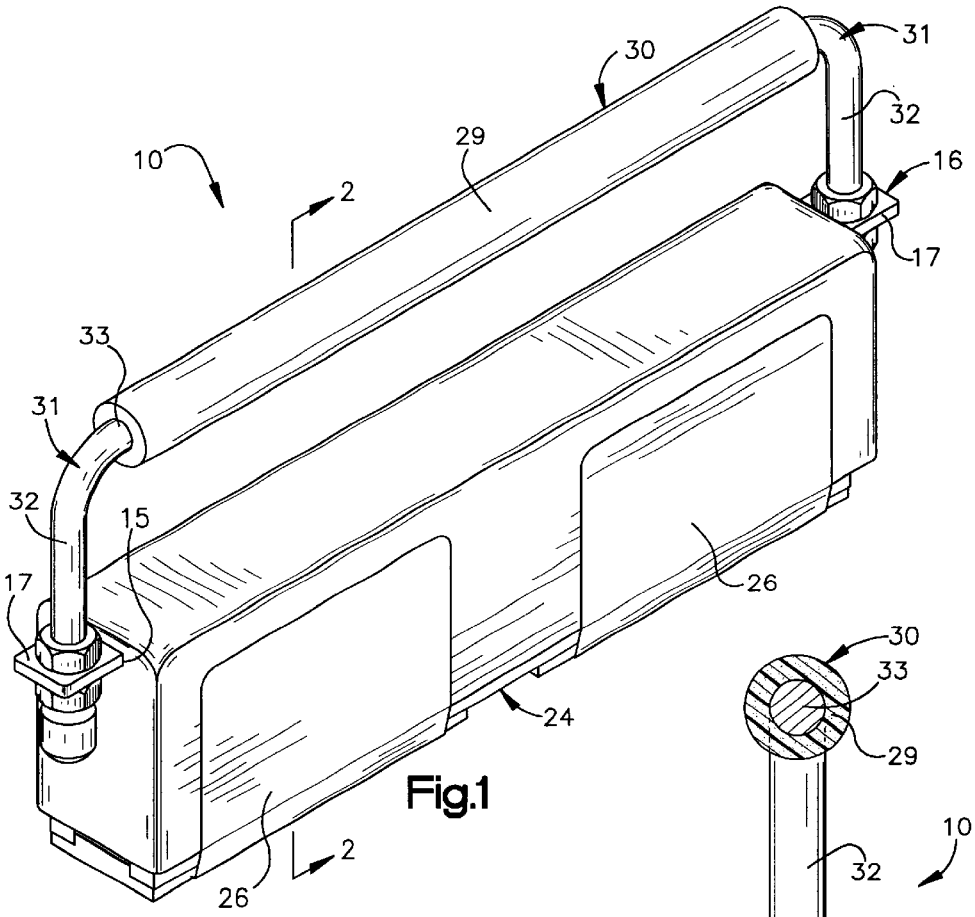
FIG. 1 is an isometric illustration of the instant invention

With reference now to the drawings, and in particular to FIG. 1 to FIG. 4 thereof, the preferred embodiment of the new and improved multipurpose hand-held magnetic pick-up tool assembly for lifting and retrieving metallic objects while providing a safer and more convenient retail display configuration embodying the principles and concepts of the present invention and generally designated by the reference numeral 10 will be described.

Referring to FIG. 1, the present invention relates to a magnetic pick-up assembly 10 comprising a generally rectangular permanent magnet 12, with two ferrous metal plates 14, one on either longitudinal side of the permanent magnet 12 and extending slightly past the exposed surface 23 of the permanent magnet 12. In effect, the permanent magnet 12 is recessed between the two ferrous metal plates 14. These two ferrous metal plates 14 serve as the north and south poles of the magnet assembly. The ferrous metal plates 14 are connected by a smaller top plate 16, made of a non-magnetic substance such as stainless steel. The top plate 16 must be a nonmagnetic material to prevent interference or disruption of the magnetic circuit, or 'shorting' of the magnetic flux from the two ferrous metal plates 14, i.e., the north and south poles of the magnet. The top plate 16 may be bonded to the ferrous metal side plates 14, by any suitable means such as welding along the intersection between the top plate 16 and the ferrous side plates 14. The permanent magnet 12 is held in place by the magnetic attraction between itself and the ferrous metal plates 14 that have become the poles of the magnet assembly 10. An adhesive may be used at the interface 13 of the permanent magnet 12 and at least one of the ferrous metal plates 14, such as double sided tape, glue, or another adhesive that can bind metal to metal or metal to ceramic. Further preventing slipping of the permanent magnet 12 are small nodules or stakes 21 on the inside bottom corners of both ferrous metal plates 14.

The two ferrous metal side plates 14 and the stainless steel connecting plate 16 are encased in a durable and protective cover 18 generally made of a polymer like vinyl, everywhere except on the primary attracting surfaces 22, 23 of the magnet assembly 10. The cover 18 serves to reduce the strength of the magnetic forces on any ferrous materials touching or near to the magnet assembly 10. The cover 18 also eliminates the need to paint or otherwise coat the exterior of the ferrous metal plates 14, and the stainless steel connecting plate 16.

The cover 18 is preferably a single piece of flexible polymer material that can be molded, for example, by dip-molding using a male mold in the form of a rectangular block. The molded cover 18 can then be heated and stretched or form fit over the plates 14, 16 and magnet 12 assembly.

The primary attracting surfaces 22, 23 are partially covered by two removable, T-shaped plastic spacers 20. The plastic spacers 20 consist of a thicker center portion that extends into the recessed area 24 created by the permanent magnet 12 and ferrous metal plate 16 configuration. The portion of the plastic spacers 20 covering the bottom of the ferrous metal plates 16 is a thinner type of flange that creates a flat or flush bottom surface for the magnet assembly when the spacers are in place. The two plastic spacers 20 leave a small gap 24 where the primary attracting surfaces 22, 23 are exposed to allow for easy testing of the magnet assembly 10 in a retail setting. The spacers 20, like the protective cover 18, reduce unwanted attractions to the primary attracting surfaces 22, 23 which is particularly important when displaying the magnet assembly 10, in a retail setting. The attraction between two such magnet assemblies 10 would be considerable without some type of non-magnetic barrier. Absent a way to reduce the magnetic attraction of the magnet assembly 10 it is easy for a consumer or employee to pinch at least their fingers between two or more magnet assemblies 10 displayed near to each other. It may also be difficult for the manufacturer and retailer to ship or otherwise move a large quantity of such magnet assemblies 10. It would be particularly difficult to display several magnet assemblies 10 together or near other magnetically attractable materials. Previously such a barrier has been erected by the packaging associated with any type of magnet tool or assembly.

The plastic spacers 20 are held in place by friction and two removable plastic stickers 26 that extend from the vinyl cover 18 on one longitudinal side of the assembly over the plastic spacers 20 onto the other longitudinal side of the vinyl cover 18. The plastic stickers 26 also provide a surface for printing product information. The protective cover 18, the plastic spacers 20, and the plastic stickers 26 combine to provide a functional and integral packaging for the magnet assembly 10, thereby eliminating the need for extra or disposable packaging when placing the magnet assembly 10 in a retail setting. The integral packaging also reduces the lateral magnetic strength of the magnet assembly relative to adjacent magnets when displayed side-by-side, and provides surfaces for the manufacturer to place product information, all without concealing or interfering with the functional aspects of the product.

Figure 2:
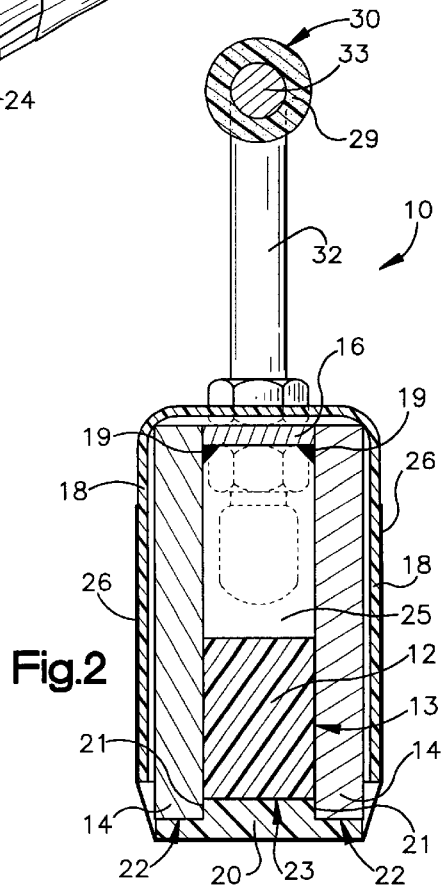
FIG. 2 is a cross-sectional view taken along the lines 2—2 of FIG. 1.
Figure 3:
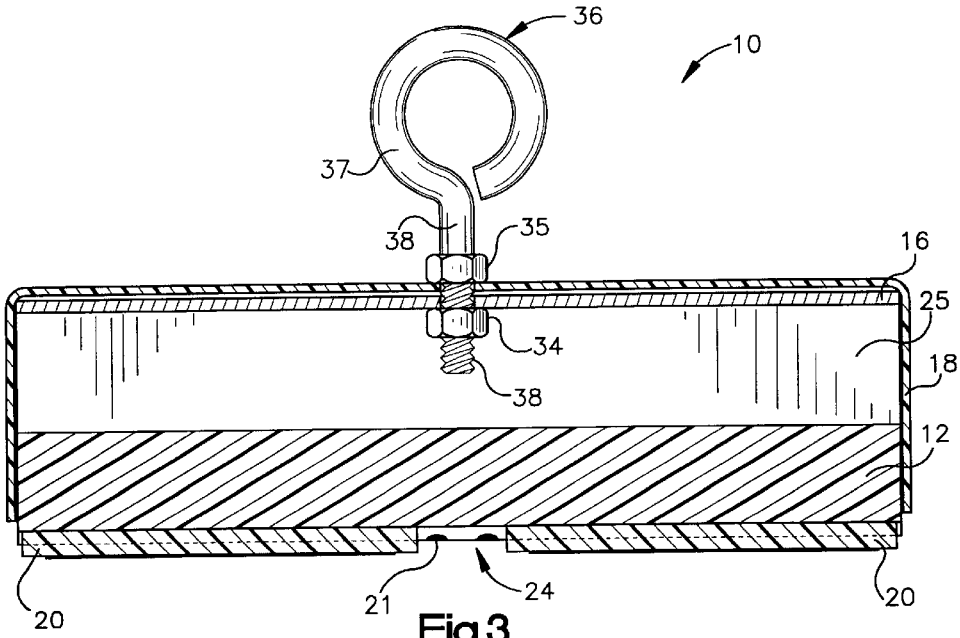
FIG. 3 is a longitudinal cross-sectional view of one embodiment of the instant invention.
Figure 4:
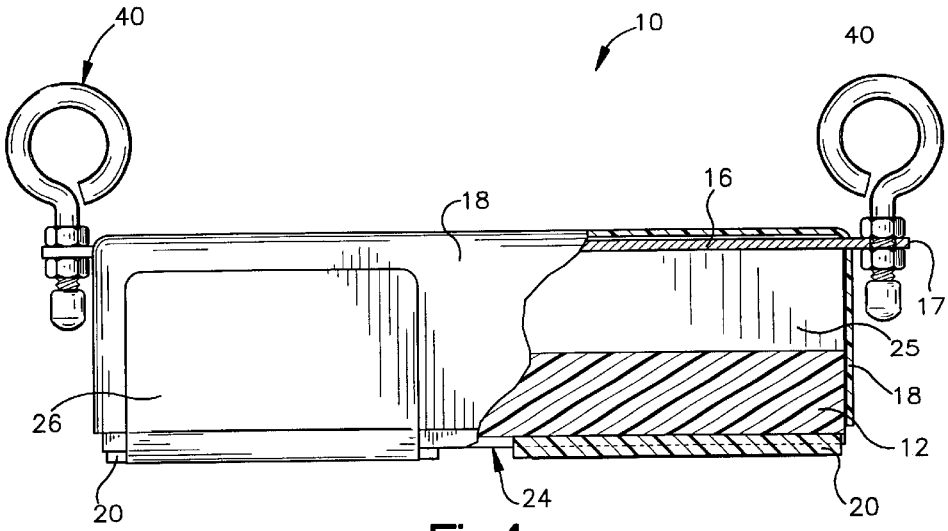
FIG. 4 is a longitudinal cross-sectional view of another embodiment of the instant invention.

The invention further comprises varied gripping or connecting apparatus such as, a handle 30 as shown in FIG. 1 and FIG. 2, a single eye-hook 36 as shown in FIG. 3, or double eye-hooks 40 as shown in FIG. 4. The handle 30 consists of a metal rod 31 with two shorter vertical lengths or legs 32 and one longer horizontal length or leg 33, and a flexible cover 29 on the horizontal length 33. The eye-hooks 36, 40 consist of a metal rod formed as a circle 37 with a stem 38. Both the handle 30 and the eye-hooks 36, 40 connect by any nut and bolt type of means. A further wide range of connecting and manipulating mechanisms performing functions similar to the handle 30 and the eye-hooks 36, 40 consisting of many shapes, sizes, and materials are envisioned. Some of these may include: a plastic handle of many forms such as a T-shape; an elastic strap; ropes; chains; clamps; etc.

To allow for connection of the handle 30 of FIG. 1, FIG. 2 and the FIG. 4, the stainless steel connecting plate 16 may extend past both ends of the magnet assembly, creating two stainless steel tabs 17 containing holes for attachment of the handle 30 or double eye-hooks 40. In the embodiments of FIG. 1 and FIG. 4 the cover 18 requires slots 15 to accommodate the stainless steel tabs 17 required by the handle 30 or double eye-hook(s) 40. In the single eye-hook embodiment of FIG. 3 the space or cavity 25 bounded by the top of the permanent magnet 12, the inside surfaces of the ferrous metal plates 14 and the stainless steel connecting plate 16 allows for clearance of the nut 34 and the stem end 38 of the eye-hook 36.

The described magnet assembly thus provides a self-packaged magnet tool which is particularly suited for distribution through traditional retail channels using hands-on product displays which encourage customer testing of the product. Because the assembly requires no extraneous packaging, the product can be thoroughly inspected at the point of purchase. Magnetic interaction between multiple units of the product displayed side-by-side is also controlled. The packaging continues to function throughout the life of the product to protect the critical magnet material.

What is claimed is:

1. A magnet tool assembly comprising:

at least one generally rectangular-shaped permanent magnet, having generally a top, a bottom, two longitudinal sides, and two lateral sides, at least two generally rectangular ferrous metal plates attached to said longitudinal sides of said permanent magnet, whereby said ferrous metal plates serve as the north and south magnetic poles of said magnet tool assembly, at least one primary attracting surface consisting of the bottom of said permanent magnet and the portions of said ferrous metal plates adjacent to the bottom of said permanent magnet where said ferrous metal plates extend past the bottom of said permanent magnet, thereby creating a recess at the interface of said primary attracting surface of said permanent magnet and said ferrous metal plates, at least one non-magnetic plate oriented parallel to the top of said permanent magnet connecting said ferrous metal plates, a cover that covers said ferrous metal plates, said non-magnetic connecting plate, and said permanent magnet, at least one spacer, covering said primary attracting surfaces, including said recess.

2. The magnet assembly of claim 1, wherein said non-magnetic connecting plate consists of stainless steel and is attached to said ferrous metal plates.

3. The magnet assembly of claim 1, where said ferrous metal plates extend past the top of said permanent magnet until reaching said non-magnetic connecting plates, thereby creating a cavity between the top of said permanent magnet and said non-magnetic connecting plate.

4. The magnet assembly of claim 1, further comprising two T-shaped spacers partially covering said primary attracting surfaces.

5. The magnet assembly of claim 1, wherein the spacer is held in place by friction.

6. The magnet assembly of claim 1, wherein the spacer is held in place by at least one removable plastic sticker, said removable plastic sticker extending from one longitudinal side of said magnet assembly over said plastic spacer onto the other longitudinal side of said magnet assembly.

7. The magnet assembly of claim 6, wherein said removable plastic sticker also serves as a display surface for product information.

8. The magnet assembly of claim 1, wherein said protective cover is preferably made of a single piece of flexible polymer material that can be molded.

9. The magnet assembly of claim 1, further comprising means for gripping, manipulating and connecting to said magnet assembly.

10. The magnet assembly of claim 9 wherein said means for gripping said magnet assembly is a handle generally comprising at least one vertical member attached to said generally rectangular magnet assembly and at least one horizontal member connected to said vertical member.

11. The magnet assembly of claim 10, where said non-magnetic connecting plate is longer than said ferrous metal plates and said permanent magnet, thereby extending outward from the lateral sides of said magnet assembly and creating a first tab at one end and a second tab at another end of the magnet assembly.

12. The magnet assembly of claim 10, where the means for gripping said magnet assembly is a handle comprising a generally U-shaped metal rod having a first end and a second end, two generally vertical members and one generally horizontal member, whereby said first end and said second end connect to said first and second tabs at the ends of said magnet assembly.

13. The magnet assembly of claim 11, further comprising a cushion material covering said generally horizontal member of said generally U-shaped metal rod, providing improved and more comfortable gripping of said rod.

14. The magnet assembly of claim 12, wherein said connecting means generally comprises a first eye-hook having a circular section and a vertical section connected to said first tab and a second eye-hook connected to said second tab.

15. The magnet assembly of claim 10, wherein the connecting means comprises a single eye-hook with a circular section and a vertical leg.

16. The magnet assembly of claim 15, wherein said eye-hook is attached to said non-magnetic connecting plate generally near the center of said non-magnetic connecting plate.

17. The magnet assembly of claim 15, wherein said vertical section of said eye-hook extends through said non-magnetic connecting plate into a cavity created by extending said ferrous metal plates beyond the top of said permanent magnet thereby creating said cavity between the top of said permanent magnet and said non-magnetic connecting plate.

18. A magnet tool assembly comprising at least one magnet;

at least one metal plate adjacent to the magnet and substantially covering a side of the magnet, whereby magnetic forces of the magnet are transferred through the plate so that metallic objects can be attracted to the plate or the magnet;

a protective cover which extends over the magnet and the plate and leaving at least one surface of the magnet exposed, a non-magnetic spacer which fits substantially flush against the exposed surface of the magnet, and a mounting plate adapted for attachment to a fixture for manipulating the magnet.

19. A magnet tool assembly comprising at least one magnet;

at least one metal plate adjacent to the magnet and substantially covering a side of the magnet, whereby magnetic forces of the magnet are transferred through the plate so that metallic objects can be attracted to the plate or the magnet;

a protective cover which extends over the magnet and the plate and leaving at least one surface of the magnet exposed, a non-magnetic spacer which fits substantially flush against the exposed surface of the magnet, wherein the at least one metal plate extends beyond the protective cover.

20. A magnet tool assembly comprising at least one magnet;

at least one metal plate adjacent to the magnet and substantially covering a side of the magnet, whereby magnetic forces of the magnet are transferred through the plate so that metallic objects can be attracted to the plate or the magnet;

a protective cover which extends over the magnet and the plate and leaving at least one surface of the magnet exposed, a non-magnetic spacer which fits substantially flush against the exposed surface of the magnet, wherein the spacers are held in contact with the magnet and plates by a flexible adhesive material, wherein the flexible adhesive material is a plastic film.

21. The magnet tool assembly of claim 20 wherein the plastic film bears product information.

22. A magnet tool assembly comprising at least one magnet;

at least one metal plate adjacent to the magnet and substantially covering a side of the magnet, whereby magnetic forces of the magnet are transferred through the plate so that metallic objects can be attracted to the plate or the magnet;

a protective cover which extends over the magnet and the plate and leaving at least one surface of the magnet exposed, a non-magnetic spacer which fits substantially flush against the exposed surface of the magnet, wherein the protective cover is molded to fit upon the plates and magnet.

23. A magnet tool assembly comprising at least one magnet;

at least one metal plate adjacent to the magnet and substantially covering a side of the magnet, whereby magnetic forces of the magnet are transferred through the plate so that metallic objects can be attracted to the plate or the magnet;

a protective cover which extends over the magnet and the plate and leaving at least one surface of the magnet exposed, a non-magnetic spacer which fits substantially flush against the exposed surface of the magnet, further comprising a mounting plate adapted for attachment to a fixture for manipulating the magnet, wherein ends of the mounting plate extend through the protective cover.

24. A magnet tool assembly comprising:

a magnet having first and second generally planar sides, a first side plate adjacent the first side of the magnet, a second side plate adjacent the second side of the magnet, edges of the side plates extending beyond a primary attracting surface of the magnet, and a protective cover which covers a substantial portion of the magnet and the side plates, and at least one spacer between the side plates.

25. The magnet tool assembly of claim 24 further comprising a non-magnetic connecting plate connected to the side plates generally opposite to the primary attracting surface of the magnet.

26. The magnet tool assembly of claim 24 further comprising an adhesive bond between the magnet and at least one of the side plates.

27. The magnet tool assembly of claim 24 further comprising stakes in an edge of at least one of the side plates extending beyond a primary attracting surface of the magnet.

28. The magnet tool assembly of claim 25 wherein the connecting plate extends through the protective cover.

29. The magnet tool assembly of claim 24 wherein the spacer contacts edges of the side plates which extend beyond the primary attracting surface of the magnet, and contacts the primary attracting surface of the magnet.

30. The magnet tool assembly of claim 24 further comprising an adhesive member S which extends over the spacer and the protective cover.

31. The magnet tool assembly of claim 25 further comprising at least one fixture attached to the connecting plate.

32. The magnet tool assembly of claim 28 further comprising at least one fixture attached to a portion of the connecting plate which extends through the protective cover.

33. A magnet tool assembly comprising:

a magnet having first and second generally planar sides, a first side plate adjacent the first side of the magnet, a second side plate adjacent the second side of the magnet, and a spacer which extends between the first and second side plates and covers a portion of the magnet, wherein the spacer is held in position by an adhesive material, wherein the spacer is held in position by a label.

34. The magnet tool assembly of claim 33 wherein the spacer is held in position by friction fit with the plates.

35. The magnet tool assembly of claim 33 wherein the spacer is comprised of multiple pieces.

36. The magnet tool assembly of claim 33 further comprising a protective cover which covers at least a portion of the first and second plates and the magnet.

* * * * *